US009183783B2

(12) United States Patent
Maeda

(10) Patent No.: US 9,183,783 B2
(45) Date of Patent: Nov. 10, 2015

(54) ORGANIC EL DISPLAY DEVICE AND METHOD OF DRIVING THE SAME

(71) Applicant: PANASONIC CORPORATION, Osaka (JP)

(72) Inventor: Tomoyuki Maeda, Osaka (JP)

(73) Assignee: JOLED INC., Tokyo (JP)

( * ) Notice: Subject to any disclaimer, the term of this patent is extended or adjusted under 35 U.S.C. 154(b) by 311 days.

(21) Appl. No.: 13/785,096

(22) Filed: Mar. 5, 2013

(65) Prior Publication Data

US 2013/0235021 A1 Sep. 12, 2013

(30) Foreign Application Priority Data

Mar. 9, 2012 (JP) ..... 2012-052651

(51) Int. Cl.
*G09G 3/30* (2006.01)
*G09G 3/32* (2006.01)
*G09G 3/00* (2006.01)

(52) U.S. Cl.
CPC ..... *G09G 3/3291* (2013.01); *G09G 3/003* (2013.01); *G09G 3/3233* (2013.01); *G09G 2300/0842* (2013.01)

(58) Field of Classification Search
CPC ..... G09G 2300/0842
See application file for complete search history.

(56) References Cited

U.S. PATENT DOCUMENTS

| | | | | |
|---|---|---|---|---|
| 8,159,480 | B2 * | 4/2012 | Tajiri | 345/204 |
| 2002/0070909 | A1 * | 6/2002 | Asano et al. | 345/76 |
| 2006/0231838 | A1 * | 10/2006 | Kim | 257/59 |
| 2007/0242068 | A1 * | 10/2007 | Han et al. | 345/427 |
| 2009/0184911 | A1 * | 7/2009 | Fukutome | 345/92 |
| 2010/0309297 | A1 | 12/2010 | Nakagawa et al. | |
| 2011/0227886 | A1 * | 9/2011 | Lee et al. | 345/204 |
| 2011/0234605 | A1 * | 9/2011 | Smith et al. | 345/522 |
| 2012/0327108 | A1 | 12/2012 | Kato et al. | |

FOREIGN PATENT DOCUMENTS

| | | | |
|---|---|---|---|
| JP | S-58-184928 | A | 10/1983 |
| JP | 2010-250111 | A | 11/2010 |
| JP | 2010-276928 | A | 12/2010 |
| JP | 2010-287956 | A | 12/2010 |
| WO | WO2011/077718 | A1 | 6/2011 |

* cited by examiner

*Primary Examiner* — Kathy Wang-Hurst
*Assistant Examiner* — Matthew Yeung
(74) *Attorney, Agent, or Firm* — McDermott Will & Emery LLP

(57) ABSTRACT

Provided is an organic EL display device including an array of pixel circuits 10 each having: organic EL element 32; storage capacity 33 that holds a voltage corresponding to an image signal; drive transistor 34 that applies a current corresponding to the voltage of storage capacity 33 to the organic EL element 32; and current switch 35 that either connects or disconnects the drive transistor 34 with the organic EL element 32. The organic EL display device also includes an inter-pixel switch 15 that connects or disconnects a node between organic EL element 32(*p*, *j*) and current switch 35(*p*, *j*) in one pixel circuit 10(*p*, *j*) out of the pair of the pixel circuits 10 that are adjacent to each other, and a node between organic EL element 32(*p*+1, *j*) and current switch 35(*p*+1, *j*) in the other pixel circuit 10(*p*+1, *j*) out of the pair of the pixel circuits 10.

5 Claims, 9 Drawing Sheets

ORGANIC EL DISPLAY DEVICE AND METHOD OF DRIVING THE SAME

BACKGROUND OF THE INVENTION

1. Field of the Invention

The present invention relates to an organic EL display device capable of alternately displaying right and left parallax images to allow a person to view these images stereoscopically using shutter glasses, and a method of driving such an organic EL display device.

2. Description of the Related Art

Organic EL display devices including an array of a large number of pixel circuits each having a self light emitting organic electroluminescence (EL) element do not require a backlight and have no limitation in their viewing angle, and are therefore expected as a next-generation image display device.

An organic EL element is a current-driven light emitting element that controls its luminance based on an amount of current flow. Methods of driving the organic EL element include a passive matrix method and an active matrix method. With the passive matrix method, it is difficult to realize a large-sized and high-definition display, while the structure of pixel circuits can be simplified. Thus, there have been developed active matrix organic EL display devices including an array of pixel circuits each having a drive transistor for each organic EL element.

In recent years, methods of displaying a three-dimensional image (stereoscopic image) using such a display device have been studied. Among these, there is known a method of alternately displaying a right-eye parallax image and a left-eye parallax image, and opening and closing shutters of shutter glasses in synchronization with displaying of the right and left parallax images such that during a period in which the right-eye parallax image is displayed, a right-eye shutter is opened and a left-eye shutter is closed so as not to allow the right-eye parallax image to be viewed by left eye, and during a period in which the left-eye parallax image is displayed, the left-eye shutter is opened and the right-eye shutter is closed so as not to allow the left-eye parallax image to be viewed by right eye.

However, as an organic EL display device updates a displayed image by performing a line-sequential writing operation for each line, a time period for displaying each parallax image is limited, resulting in a problem of a significant reduction in luminance of the displayed image.

In order to prevent such luminance reduction, there is proposed an organic EL display device having pixel circuits each provided with a first storage capacity and a second storage capacity, where a line-sequential writing operation is performed to the first storage capacity while an image is displayed using the second storage capacity, the line-sequential writing operation is performed to the second storage capacity while an image is displayed using the first storage capacity after the writing operation to the first storage capacity is completed, and whereby the displayed image is updated (see International Publication No. WO2011/077718, for example).

According to the organic EL display device described in WO2011/077718, the most part of the driving time can be used for displaying images even when displaying three-dimensional images. However, this organic EL display device requires two large-area storage capacities for each pixel circuit, and therefore a proportion of a light-emitting region for each pixel circuit is reduced. This results in a problem that it is not possible to display an image with high luminance. In addition, even when displaying normal two-dimensional images (planar images), similarly it is not possible to display an image with high luminance.

SUMMARY OF THE INVENTION

The technique disclosed herein relates to an organic EL display device comprising: an array of a plurality of pixel circuits, each of the pixel circuits including: an organic EL element; a storage capacity for holding a voltage corresponding to an image signal; a drive transistor for applying a current to the organic EL element, the current corresponding to the voltage of the storage capacity; and a current switch for either connecting or disconnecting the drive transistor with the organic EL element. There is provided an inter-pixel switch for either connecting or disconnecting a node between the organic EL element and the current switch in one of a pair of the pixel circuits that are adjacent to each other and a node between the organic EL element and the current switch in the other of the pair of the pixel circuits.

Further, the technique disclosed herein relates to a method of driving the above organic EL display device. When displaying a two-dimensional image, the inter-pixel switch is turned to a disconnected state, the voltage of the storage capacity of the pixel circuit is sequentially updated in response to an image signal of the two-dimensional image, and a current in response to the updated voltage of the storage capacity is applied to the organic EL element of the pixel circuit, thereby causing the organic EL element to emit light. Moreover, when displaying a three-dimensional image by alternately displaying a right-eye parallax image and a left-eye parallax image, the inter-pixel switch is turned to a connected state to form a pixel circuit pair, the voltages of the storage capacities of the pixel circuits in the pixel circuit pair are alternately updated based on image signals of the parallax images, and in a period in which the voltage of the storage capacity of one of the pixel circuits in the pixel circuit pair is updated, the current switch in the one of the pixel circuits is turned to a disconnected state and the current switch in the other of the pixel circuits is turned to a connected state, and a current in response to the voltage of the storage capacity of the other of the pixel circuits is applied to the organic EL elements of the pixel circuits that form the pixel circuit pair, thereby causing the organic EL elements to emit light.

Furthermore, the technique disclosed herein relates to an organic EL display device including: pixel circuits disposed respectively at intersections between a plurality of data lines and a plurality of scanning lines that intersect the data lines, each pixel circuit having: an organic EL element; a storage capacity for holding a voltage corresponding to an image signal; a drive transistor for applying a current to the organic EL element, the current corresponding to the voltage of the storage capacity; and a current switch for either connecting or disconnecting the drive transistor with the organic EL element. Each of a plurality of the pixel circuits sharing one of the data lines includes: a first inter-pixel switch for either connecting or disconnecting a node between the organic EL element and the current switch in the pixel circuit having a p-th line of the scanning lines (where p is an odd number) and a node between the organic EL element and the current switch in the pixel circuit having a (p+1)th line of the scanning lines; and a second inter-pixel switch for either connecting or disconnecting a node between the organic EL element and the current switch in the pixel circuit having a q-th line of the scanning lines (where q is an even number) and a node between the organic EL element and the current switch in the pixel circuit having a (q+1)th line of the scanning lines.

Further, the technique disclosed herein relates to a method of driving this organic EL display device. When displaying a two-dimensional image, the first inter-pixel switch and the second inter-pixel switch are turned to a disconnected state, the voltage of the storage capacity of the pixel circuit is sequentially updated in response to an image signal of the two-dimensional image, and a current in response to the updated voltage of the storage capacity is applied to the organic EL element of the pixel circuit, thereby causing the organic EL element to emit light. Moreover, when displaying a three-dimensional image by alternately displaying a right-eye parallax image and a left-eye parallax image, one of the first inter-pixel switch and the second inter-pixel switch is turned to a connected state and the other is turned to a disconnected state to form a pixel circuit pair, the voltages of the storage capacities of the pixel circuits in the pixel circuit pair are alternately updated based on image signals of the parallax images, and in a period in which the voltage of the storage capacity of one of the pixel circuits in the pixel circuit pair is updated, the current switch in the one of the pixel circuits is turned to a disconnected state and the current switch in the other of the pixel circuits is turned to a connected state, and a current in response to the voltage of the storage capacity of the other of the pixel circuits is applied to the organic EL elements of the pixel circuits that form the pixel circuit pair, thereby causing the organic EL elements to emit light.

DETAILED DESCRIPTION OF THE PREFERRED EMBODIMENTS

Hereinafter, an organic EL display device according to embodiments will be described with reference to the drawings.

First Exemplary Embodiment

Figure 1:
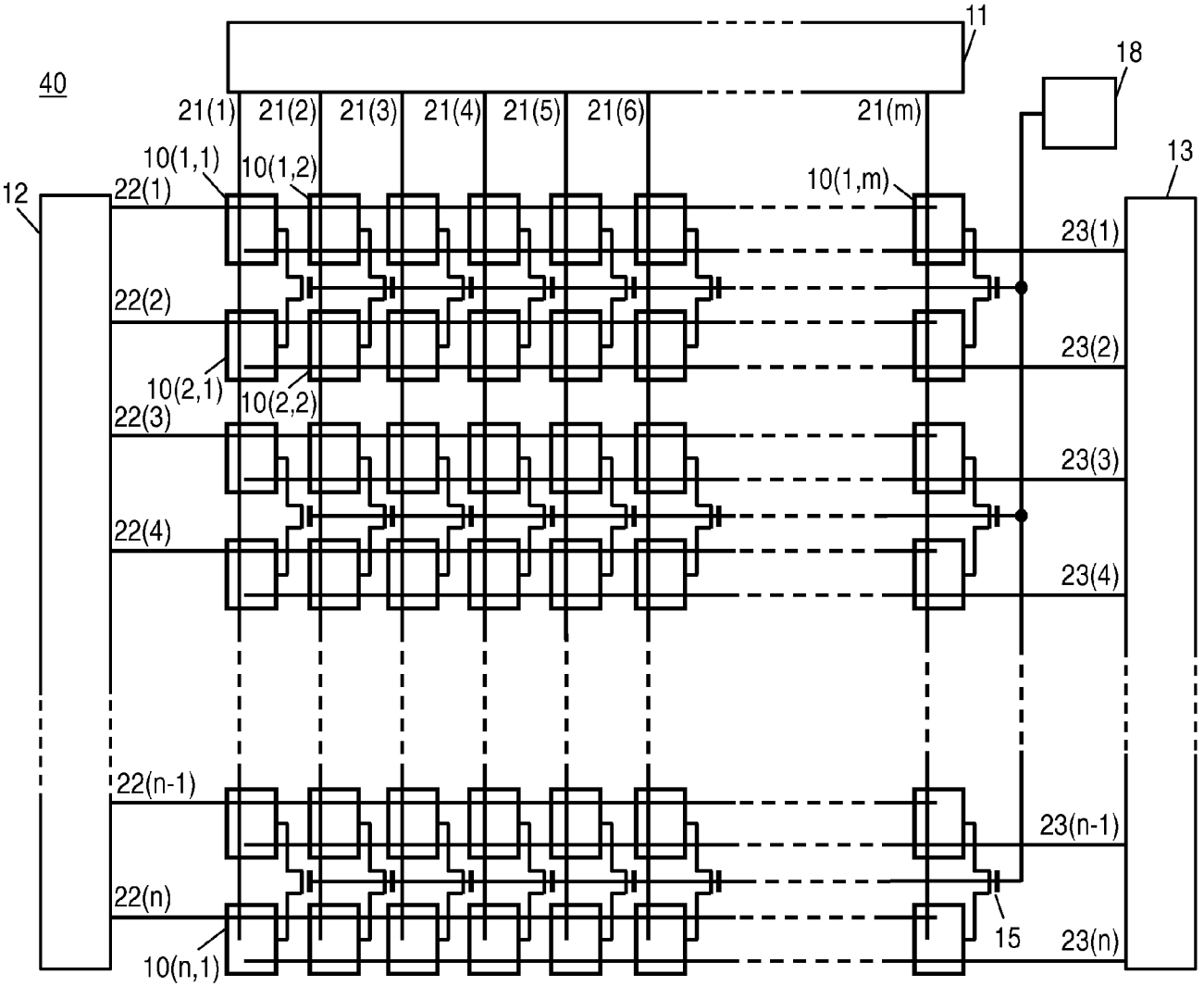
FIG. 1 is a schematic diagram illustrating a configuration of an organic EL display device according to a first embodiment.

FIG. 1 is a schematic diagram illustrating a configuration of organic EL display device 40 according to a first embodiment. Organic EL display device 40 according to this embodiment is provided with pixel circuits 10(*i, j*), data line drive circuit 11, scanning line drive circuit 12, light-emission control circuit 13, inter-pixel switches 15, inter-pixel switch control circuit 18, and a power supply circuit (not depicted). Here, "i" is an integer from "1" to "n" inclusive, and "j" is an integer from "1" to "m" inclusive.

A plurality of pixel circuits 10(*i, j*) are arranged in matrix so as to constitute an image display surface, and each pixel circuit includes an organic EL element that emits red, green, or blue light. Pixel circuits 10(1, *j*) to 10(*n, j*) that are arranged in a column direction in FIG. 1 are connected to common data line 21(*j*), and pixel circuits 10(*i*, 1) to 10(*i, m*) that are arranged in a line direction are connected to common scanning line 22(*i*) and common light-emission control line 23(*i*).

In the following description, pixel circuits 10(*i*, 1) to 10(*i, m*) that are arranged in a line direction is represented by line i, and lines of pixel circuits are represented by line 1, line 2, . . . , line (n−1), and line n in order from the top of an image display surface.

Data line drive circuit 11 converts an image signal to a data signal corresponding to luminance of light to be emitted from each pixel circuit 10(*i, j*), and applies the data signal to each data line 21(*j*).

Scanning line drive circuit 12 supplies a scanning signal to each scanning line 22(*i*) to allow each pixel circuit 10(*i, j*) to take the data signal. FIG. 1 shows a configuration in which single scanning line 22(*i*) is connected to single pixel circuit 10(*i, j*) in order to make the description simple. However, in order to correct variation in luminance of pixel circuits 10(*i, j*), a set of scanning lines including a plurality of scanning lines may be connected to single pixel circuit 10(*i, j*).

Light-emission control circuit 13 supplies a light-emission control signal to each light-emission control line 23(*i*) to control the organic EL element of each pixel circuit 10(*i, j*) to emit or not to emit light.

As described above, in organic EL display device 40 according to this embodiment, pixel circuits 10(*i, j*) are respectively disposed at intersections between the plurality of data lines 21(*j*) and the plurality of scanning lines 22(*i*) that intersect the data lines.

Inter-pixel switches 15 are each configured by a thin-film field-effect transistor, and provided with respect to a pair of adjacent pixel circuits 10(*p, j*) and 10(*p*+1, *j*) so as to either connect or disconnect the organic EL elements of one pixel circuit 10(*p, j*) and the other pixel circuit 10(*p*+1, *j*). Here, "p" is an odd number from "1" to "n" inclusive. Gates of inter-pixel switches 15 are connected with each other. Inter-pixel switch control circuit 18 supplies an inter-pixel control signal for controlling connection or disconnection of each inter-pixel switch 15 to the gate of corresponding inter-pixel switch 15.

The power supply circuit is connected to power lines to pixel circuits 10(*i, j*), and supplies electrical power to pixel circuits 10(*i, j*).

Figure 2:
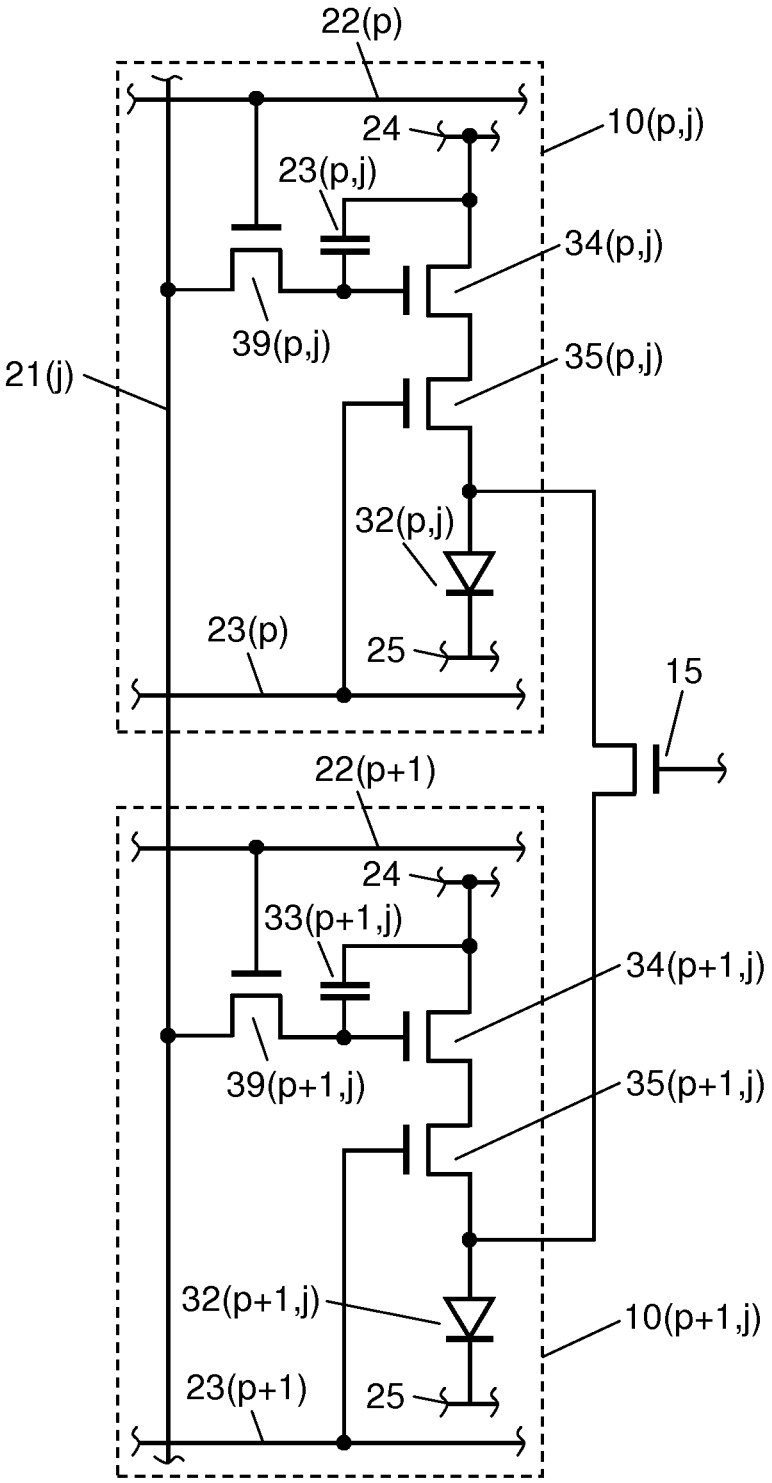
FIG. 2 is a circuit diagram of a pixel circuit of the organic EL display device.

FIG. 2 is a circuit diagram of pixel circuits 10(*i, j*) of organic EL display device 40 according to the first embodiment, showing the pair of adjacent pixel circuits 10(*p, j*) and 10(*p*+1, *j*) and inter-pixel switch 15 connected thereto.

Pixel circuit 10(*p, j*) according to this embodiment includes organic EL element 32(*p, j*), storage capacity 33(*p, j*), drive transistor 34(*p, j*), current switch 35(*p, j*), and write switch 39(*p, j*).

Organic EL element 32(*p, j*) is a current-driven light emitting element that controls its luminance based on an amount of current flow, and emits red, green, or blue light. Storage capacity 33(*p, j*) is charged to a voltage corresponding to a predetermined data signal, and holds this voltage. Drive transistor 34(*p, j*) in this embodiment is a P-channel thin-film field-effect transistor. As will be described in detail later, if current switch 35(*p, j*) is in a connected state (ON state) and inter-pixel switch 15 is in a disconnected state (OFF state), a current corresponding to the voltage of storage capacity 33(*p, j*) is applied to organic EL element 32(*p, j*). Further, if current switch 35(*p, j*) is in the connected state and inter-pixel switch 15 is in the connected state, the current corresponding to the voltage of storage capacity 33(*p, j*) is applied to organic EL element 32(*p, j*) and organic EL element 32(*p*+1, *j*).

Between drive transistor 34(*p, j*) and organic EL element 32(*p, j*), current switch 35(*p, j*) is connected. In this embodiment, a source of drive transistor 34(*p, j*) is connected to high-voltage-side power line 24, a drain of drive transistor 34(*p, j*) is connected to a drain (or a source) of current switch 35(*p, j*), the source (or the drain) of current switch 35(*p, j*) is connected to an anode of organic EL element 32(*p, j*), and a cathode of organic EL element 32(*p, j*) is connected to low-voltage-side power line 25. Then, a gate of current switch 35(*p, j*) is connected to light-emission control line 23(*p*).

Further, one terminal of storage capacity 33(*p, j*) is connected to the source of drive transistor 34(*p, j*), and the other terminal of storage capacity 33(*p, j*) is connected to a gate of drive transistor 34(*p, j*) as well as to data line 21(*j*) via write switch 39(*p, j*). Moreover, a gate of write switch 39(*p, j*) is connected to scanning line 22(*p*).

FIG. 2 shows a configuration in which storage capacity 33(*p, j*) is charged using only one write switch 39(*p, j*) in order to make the description simple. However, storage capacity 33(*p, j*) may be charged using a plurality of switches including a function for correcting a threshold voltage of drive transistor 34(*p, j*) for correcting variation in luminance of pixel circuit 10(*p, j*).

Pixel circuit 10(*p*+1, *j*) is also configured in the same manner as pixel circuit 10(*p, j*), and includes organic EL element 32(*p*+1, *j*), storage capacity 33(*p*+1, *j*), drive transistor 34(*p*+1, *j*), and current switch 35(*p*+1, *j*), and current switch 35(*p*+1, *j*) is connected between drive transistor 34(*p*+1, *j*) and organic EL element 32(*p*+1, *j*). Organic EL element 32(*p*+1, *j*) is a current-driven light emitting element that emits light of the same color as organic EL element 32(*p, j*).

As described above, pixel circuit 10(*i, j*) according to this embodiment includes organic EL element 32(*i, j*), storage capacity 33(*i, j*) that holds a voltage corresponding to an image signal, drive transistor 34(*i, j*) that applies a current corresponding to the voltage of storage capacity 33(*i, j*) to the organic EL element, and current switch 35(*i, j*) that either connects or disconnects the drive transistor with the organic EL element.

Then, inter-pixel switch 15 connects or disconnects a node between organic EL element 32(*p, j*) and current switch 35(*p, j*) in one pixel circuit 10(*p, j*) out of the pair of the pixel circuits that are adjacent to each other, and a node between organic EL element 32(*p*+1, *j*) and current switch 35(*p*+1, j) in the other pixel circuit 10(*p*+1, *j*) out of the pair of the pixel circuits.

Here, a voltage supplied to high-voltage-side power line 24 is 20 (V), for example and a voltage supplied to low-voltage-side power line 25 is 0 (V), for example. However, it is desirable that these voltages be optimally set according to the configuration of the pixel circuits and characteristics of organic EL elements. Further, while drive transistors 34(*p, j*) and 34 (p+1, j) are described as a P-channel thin-film field-effect transistor, these drive transistors may be configured as an N-channel transistor.

As described above, organic EL display device 40 according to this embodiment is provided with only one large-area storage capacity 33(*i, j*) for each pixel circuit 10(*i, j*), and therefore it is possible to design such that an increased proportion of a light-emitting region is provided for each pixel circuit 10(*i, j*).

Next, a method of driving organic EL display device 40 according to this embodiment will be described. Each pixel circuit 10(*i, j*) performs a writing operation and a light-emitting operation. Further, an initialization operation is performed before the writing operation as needed.

The initialization operation is an operation in which the voltage of storage capacity 33(*i, j*) is initialized and a threshold voltage of drive transistor 34(*i, j*) is detected. However, in this embodiment, a circuit for detecting and correcting the threshold voltage of drive transistor 34(*i, j*) is not described in order to make the description simple. Therefore, the initialization operation will not be described herein.

In the writing operation, write switch 39(*i, j*) is turned to a connected state, and a voltage corresponding to the data signal that is supplied to data line 21(*j*) is applied to storage capacity 33(*i, j*). Then, write switch 39(*i, j*) is turned to a disconnected state. The writing operation is an operation in which storage capacity 33(*i, j*) is charged to the voltage corresponding to the data signal in this manner. As storage capacity 33(*i, j*) holds this voltage after the writing operation, a gate-source voltage of drive transistor 34(*i, j*) is also held at the voltage corresponding to the data signal.

Time required for the writing operation for each line is approximately from 4 μs to 5 μs. Accordingly, provided that the number of lines in organic EL display device 40 is defined as n="2000", time required until the writing operation is completed for all lines is approximately from 8 ms to 10 ms for each frame.

The light-emitting operation is an operation in which a current is applied to organic EL element 32(*i, j*) to cause organic EL element 32(*i, j*) to emit light.

First, the method of driving organic EL display device 40 according to this embodiment in a case in which a two-dimensional image is displayed is described.

Figure 3:
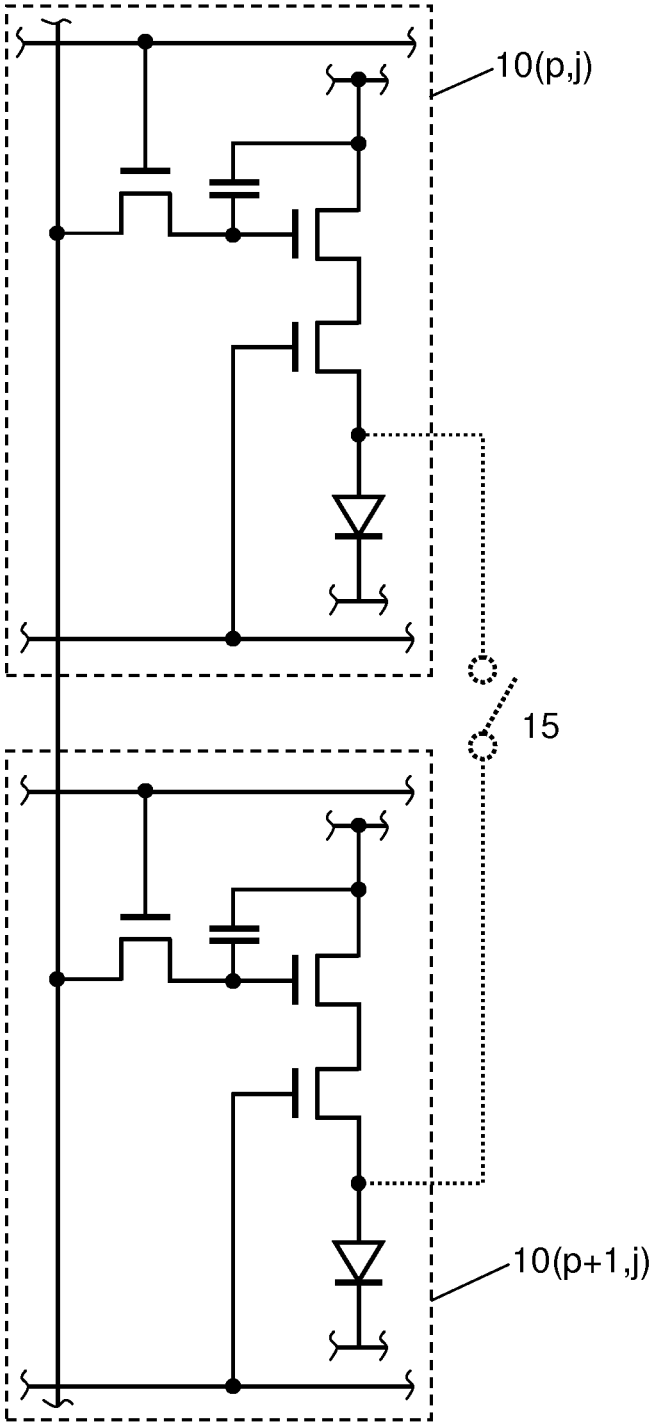
FIG. 3 is a diagram for illustration of an operation of the organic EL display device.

FIG. 3 is a diagram for illustration of an operation of organic EL display device 40 according to the first embodiment. When displaying a two-dimensional image, inter-pixel switch 15 is turned to the disconnected state so that pixel circuit 10(*p, j*) and pixel circuit 10(*p*+1, *j*) independently operate without interfering each other.

Figure 4:
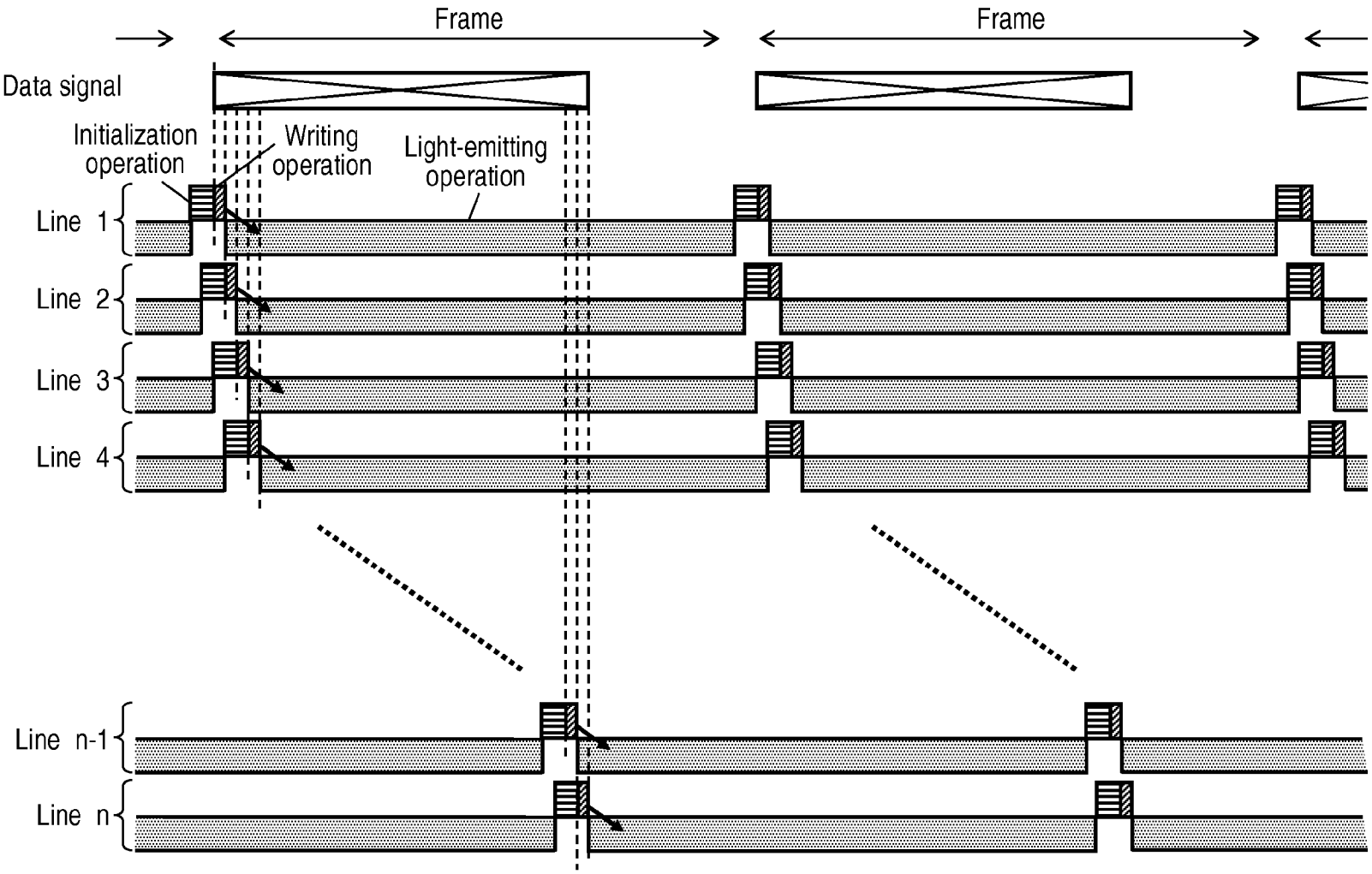
FIG. 4 is a timing chart for showing the operation of the organic EL display device.

FIG. 4 is a timing chart for showing the operation of organic EL display device 40 according to the first embodiment when displaying a two-dimensional image.

In this embodiment, a case in which a so-called progressive signal is inputted is described, where image signals are sequentially transmitted line by line within a single frame period. A frame frequency is set to 60 Hz in order to display a flickerless two-dimensional image. Upon input of the progressive signal for a two-dimensional image, data line drive circuit 11 supplies a data signal to each of data lines 21(*j*) in order from line 1, line 2, . . . , to line n.

First, at the beginning of a single frame period, data line drive circuit 11 supplies a data signal corresponding to an image signal for line 1 (data signal for line 1) to each of data lines 21(*j*), and scanning line drive circuit 12 drives a scanning signal for scanning line 22(1) to high level. This turns write switches 39(1, *j*) for line 1 to the connected state, and the voltages corresponding to the data signals supplied to data lines 21(*j*) are applied to storage capacities 33(1, *j*) for line 1. Then, scanning line drive circuit 12 drives the scanning signal for scanning line 22(1) back to low level. In this manner, the writing operation for charging storage capacities 33(1, *j*) is performed in pixel circuits 10(1, *j*) for line 1.

Then, light-emission control circuit 13 drives a light-emission control signal for light-emission control line 23(1) to high level. This turns current switches 35(1, *j*) for line 1 to the connected state, and a current flows from drive transistors 34(1, j) for line 1 to organic EL elements 32(1, j) for line 1 so that organic EL elements 32(1, j) for line 1 emit light at luminance corresponding to the image signals for line 1. Here, before pixel circuits 10(1, j) for line 1 perform the writing operation (or the initialization operation) in the next frame, light-emission control circuit 13 drives the light-emission control signal for light-emission control line 23(1) back to low level.

Next, data line drive circuit 11 supplies a data signal for line 2 to each of data lines 21(j), and scanning line drive circuit 12 drives a scanning signal for scanning line 22(2) to high level. With this, the writing operation for charging storage capacities 33(2, j) of pixel circuits 10(2, j) for line 2 to voltages corresponding to image signals to be displayed by line 2 is performed.

Then, light-emission control circuit 13 drives a light-emission control signal for light-emission control line 23(2) to high level to cause organic EL elements 32(2, j) for line 2 to emit light at luminance corresponding to the image signals for line 2. Here, before pixel circuits 10(2, j) for line 2 perform the writing operation (or the initialization operation) in the next frame, light-emission control circuit 13 drives the light-emission control signal for light-emission control line 23(2) back to low level.

Thereafter, in the same manner, the writing operation is performed sequentially for each line to line n, and the light-emitting operation is then performed sequentially from the line to which the writing operation has been performed. The light-emitting operation for each line continues until the writing operation (or the initialization operation) in the next frame is performed.

In this manner, the image signals for the first line are displayed by pixel circuits 10(1, j) for line 1, the image signals for the second line are displayed by pixel circuits 10(2, j) for line 2, . . . , and the image signals for the n-th line are displayed by pixel circuits 10(n, j) for line n.

By driving in the above manner, it is possible to use the most part of the driving time for displaying an image, and thus to display a two-dimensional image with high luminance.

In the above description, it is assumed that the image signal is a progressive signal. Accordingly, data line drive circuit 11 supplies the data signals to data lines 21(j) in the order of line 1, line 2, line 3, . . . , and line n, and pixel circuits (i, j) perform the writing operation in the order of line 1, line 2, line 3, . . . , and line n. However, in a case in which the image signal is a so-called interlaced signal, data line drive circuit 11 supplies the data signals to data lines 21(j) in the order of line 1, line 3, line 5, . . . , line 2, line 4, line 6, and so on, and therefore pixel circuit 10(i, j) may perform the writing operation also in the order of line 1, line 3, line 5, . . . , line 2, line 4, line 6, and so on.

As described above, when displaying a two-dimensional image, inter-pixel switch 15 is turned to the disconnected state, the voltage of storage capacity 33(i, j) of pixel circuit 10(i, j) is sequentially updated according to the image signal of the two-dimensional image, and the current according to the updated voltage of storage capacity 33(i, j) is applied to organic EL element 32(i, j) of pixel circuit 10(i, j), thereby causing the organic EL elements to emit light.

Next, a case in which a three-dimensional image is displayed is described. The three-dimensional image is realized by alternately and repeatedly displaying a right-eye parallax image and a left-eye parallax image, and allowing a person to view these images stereoscopically using shutter glasses that open and close in synchronization with the corresponding parallax images.

Figure 5A:
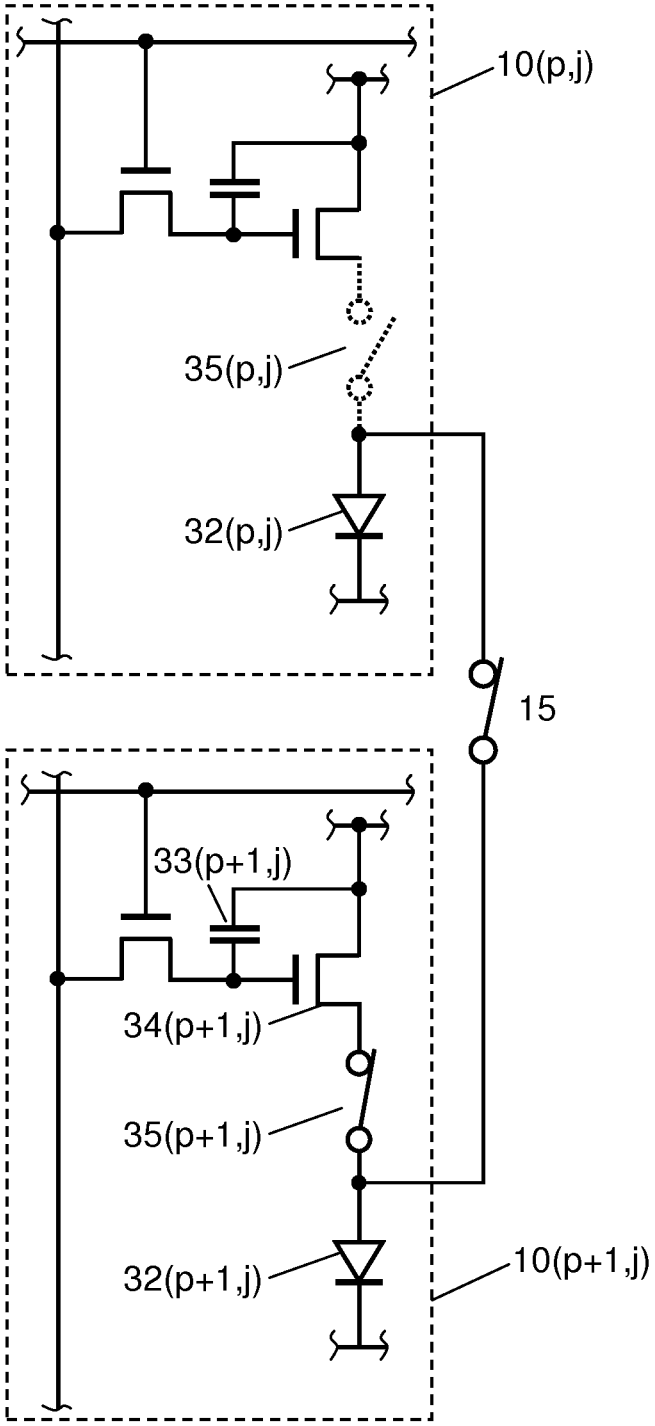
FIG. 5A is a diagram for illustration of the operation of the organic EL display device.
Figure 5B:
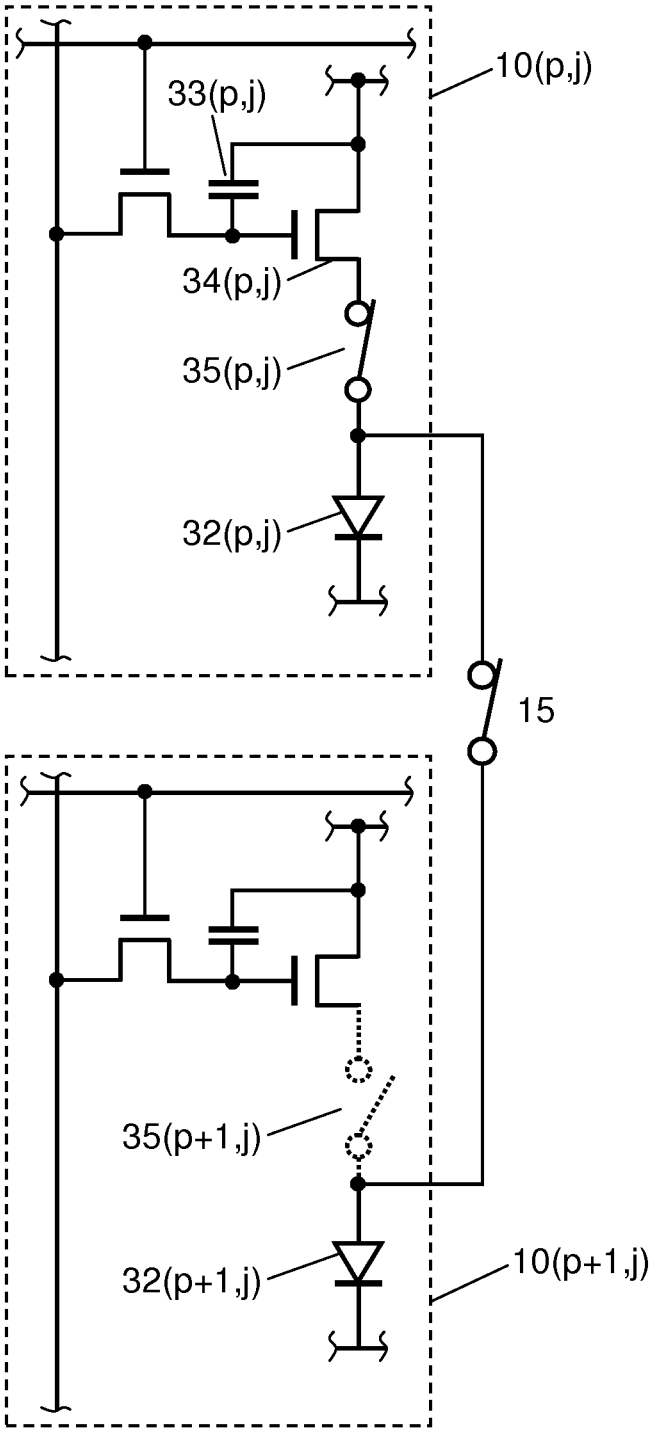
FIG. 5B is a diagram for illustration of the operation of the organic EL display device.
Figure 6:
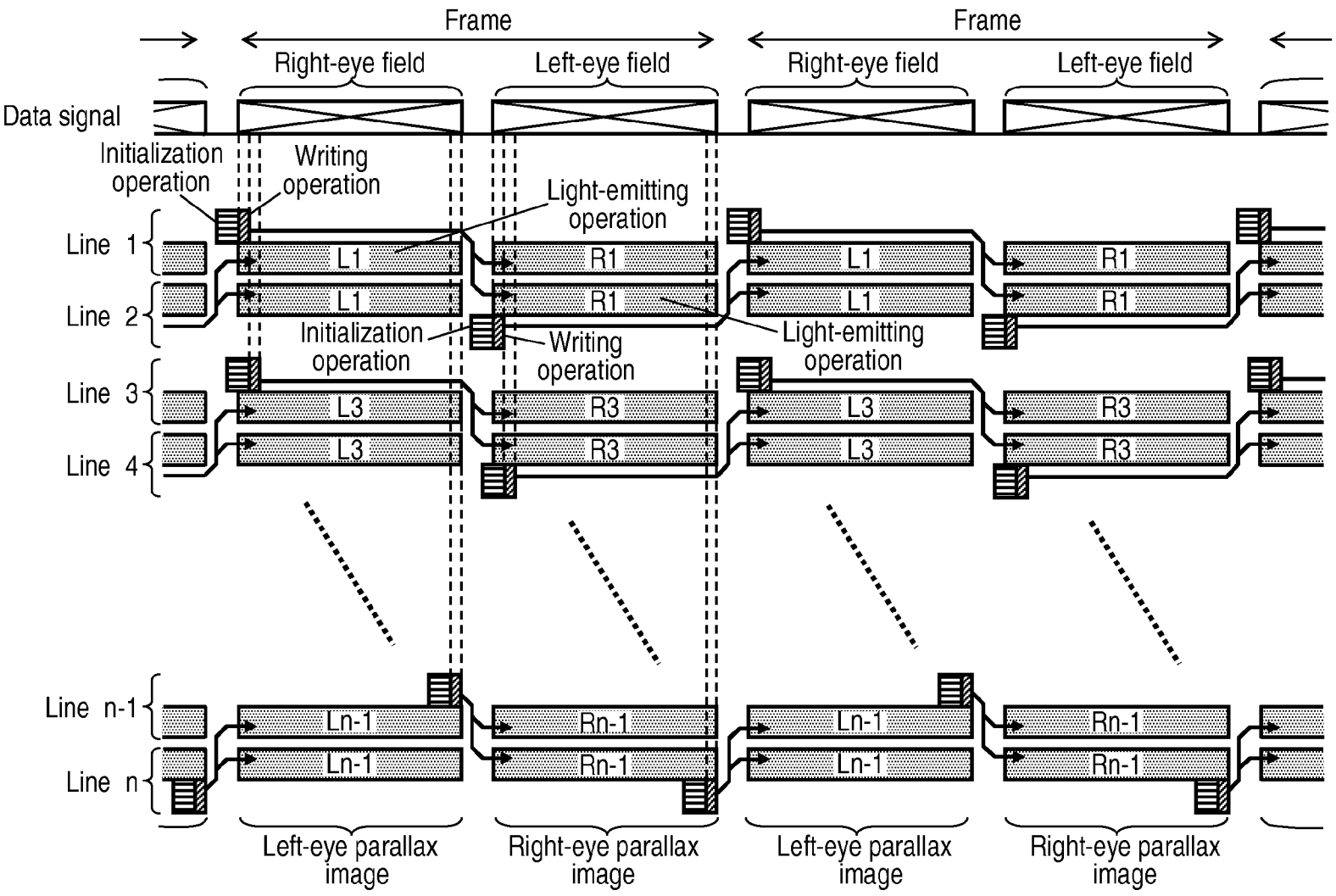
FIG. 6 is a timing chart for showing the operation of the organic EL display device.

FIG. 5A and FIG. 5B are diagrams for illustration of the operation of organic EL display device 40 according to the first embodiment. Further, FIG. 6 is a timing chart for showing the operation of organic EL display device 40, when displaying a three-dimensional image.

In order to display a three-dimensional image, a single frame is constituted from a right-eye field for transmitting an image signal for the right-eye parallax image and a left-eye field for transmitting an image signal for the left-eye parallax image, and the image signals for the respective parallax images are transmitted by alternately repeating the right-eye field and the left-eye field. A frame frequency is set to 60 Hz in order to display a flickerless stereoscopic image. Therefore, a field frequency is 120 Hz, and time required for transmitting the image signal for each of the parallax images is reduced to about half of the time required for transmitting the image signal for the two-dimensional image.

In order to display a three-dimensional image in this manner, it is necessary to perform the writing operation of the image signal for each of the parallax images within a period that is half of that for the two-dimensional image. Accordingly, for each image signal of the corresponding parallax image, data line drive circuit 11 sequentially supplies either data signals for an odd numbered line or data signals for an even numbered line to respective data lines 21(j).

In this embodiment, the description is provided assuming that data line drive circuit 11 sequentially supplies only the data signals for the odd numbered line to respective data lines 21(j). Specifically, data line drive circuit 11 supplies a data signal for an image signal for a right-eye parallax image (right-eye data signal) in the order of line 1, line 3, line 5, . . . , and line (n−1) in the right-eye field, and a data signal for an image signal for a left-eye parallax image (left-eye data signal) in the order of line 1, line 3, line 5, . . . , and line (n−1) in the left-eye field.

When displaying a three-dimensional image, inter-pixel switch 15 is turned to the connected state so as to connect organic EL element 32(p, j) for the odd numbered line and organic EL element 32(p+1, j) for the even numbered line.

First, in the right-eye field, as illustrated in FIG. 5A, current switch 35(p, j) for the odd numbered line is turned to the disconnected state, and current switch 35(p+1, j) for the even numbered line is turned to the connected state. Then, the current flows from drive transistor 34(p+1, j) for the even numbered line to organic EL element 32(p+1, j) for the even numbered line, as well as to organic EL element 32(p, j) for the odd numbered line via inter-pixel switch 15. In this manner, organic EL element 32(p, j) for the odd numbered line and organic EL element 32(p+1, j) for the even numbered line emit light.

Here, storage capacity 33(p+1, j) for the even numbered line is charged to a voltage corresponding to the left-eye data signal in an immediately previous left-eye field. Then, as drive transistor 34(p+1, j) applies a current corresponding to the left-eye data signal to organic EL element 32(p, j) and organic EL element 32(p+1, j), the left-eye parallax image is displayed in the right-eye field as illustrated in FIG. 6.

Further, at the beginning of the right-eye field, data line drive circuit 11 supplies right-eye data signals R1 corresponding to line 1 to respective data lines 21(j), and scanning line drive circuit 12 drives a scanning signal for scanning line 22(1) to high level. Then, the writing operation for charging storage capacities 33(1, j) of pixel circuits 10(1, j) for line 1 to voltages corresponding to right-eye data signals R1 is performed.

Next, data line drive circuit 11 supplies right-eye data signals R3 corresponding to line 3 to respective data lines 21(*j*), and scanning line drive circuit 12 drives a scanning signal for scanning line 22(3) to high level. Then, the writing operation for charging storage capacities 33(3, *j*) of pixel circuits 10(3, *j*) for line 3 to voltages corresponding to right-eye data signals R3 is performed.

Thereafter, in the same manner, the writing operation for charging storage capacities 33(*p, j*) of pixel circuits 10(*p, j*) for odd numbered line p to voltages corresponding to right-eye data signals Rp corresponding to odd numbered line p is sequentially performed.

As described above, in the right-eye field, the left-eye parallax image is displayed by organic EL elements 32(*p, j*) for the odd numbered line and organic EL elements 32(*p*+1, *j*) for the even numbered line, while performing the writing operation of the right-eye data signals for the odd numbered line by pixel circuits 10(*p, j*) for the odd numbered line.

Then, as the left-eye parallax image at this time, as illustrated in FIG. 6, left-eye data signals L1 for the first line are displayed by pixel circuits 10(1, *j*) for line 1 and pixel circuits 10(2, *j*) for line 2, left-eye data signals L3 for the third line are displayed by pixel circuits 10(3, *j*) for line 3 and pixel circuits 10(4, *j*) for line 4, . . . , and left-eye data signals L(n−1) for the (n−1)th line are displayed by pixel circuits 10(*n*−1, j) for line (n−1) and pixel circuits 10(*n, j*) for line n.

In the subsequent left-eye field, as illustrated in FIG. 5B, current switch 35(*p*+1, *j*) for the even numbered line is turned to the disconnected state, and current switch 35(*p, j*) for the odd numbered line is turned to the connected state. Then, the current flows from drive transistor 34(*p, j*) for the odd numbered line to organic EL element 32(*p, j*) for the odd numbered line, as well as to organic EL element 32(*p*+1, *j*) for the even numbered line via inter-pixel switch 15. In this manner, organic EL element 32(*p, j*) for the odd numbered line and organic EL element 32(*p*+1, *j*) for the even numbered line emit light.

Here, as storage capacity 33(*p, j*) for the odd numbered line is charged to a voltage corresponding to the right-eye data signal in an immediately previous right-eye field, the right-eye parallax image is displayed in the left-eye field.

Further, at the beginning of the left-eye field, data line drive circuit 11 supplies left-eye data signals L1 corresponding to line 1 to respective data lines 21(*j*), and scanning line drive circuit 12 drives a scanning signal for scanning line 22(2) to high level. Then, the writing operation for charging storage capacities 33(2, *j*) of pixel circuits 10(2, *j*) for line 2 to voltages corresponding to data signals L1 is performed.

Next, data line drive circuit 11 supplies left-eye data signals L3 corresponding to line 3 to respective data lines 21(*j*), and scanning line drive circuit 12 drives a scanning signal for scanning line 22(4) to high level. Then, the writing operation for charging storage capacities 33(4, *j*) of pixel circuits 10(4, *j*) for line 4 to voltages corresponding to left-eye data signals L3 is performed.

Thereafter, in the same manner, the writing operation for charging storage capacities 33(*p*+1, *j*) of pixel circuits 10(*p*+1, *j*) for even numbered line (p+1) to voltages corresponding to left-eye data signals Lp corresponding to odd numbered line p is sequentially performed.

As described above, in the left-eye field, the right-eye parallax image is displayed by organic EL elements 32(*p, j*) for the odd numbered line and organic EL elements 32(*p*+1, *j*) for the even numbered line, while performing the writing operation of the left-eye data signals for the odd numbered line by pixel circuits 10(*p*+1, *j*) for the even numbered line.

Then, as the right-eye parallax image at this time, as illustrated in FIG. 6, right-eye data signals R1 for the first line are displayed by pixel circuits 10(1, *j*) for line 1 and pixel circuits 10(2, *j*) for line 2, right-eye data signals R3 for the third line are displayed by pixel circuits 10(3, *j*) for line 3 and pixel circuits 10(4, *j*) for line 4, . . . , and right-eye data signals R(n−1) for the (n−1)th line are displayed by pixel circuits 10(*n*−1, j) for line(n−1) and pixel circuits 10(*n, j*) for line n.

Thereafter, by driving in the same manner repeatedly, it is possible to use the most part of the driving time for displaying an image, and thus to display a three-dimensional image with high luminance even when displaying a three-dimensional image.

As described above, when displaying a three-dimensional image by alternately displaying the right-eye parallax image and the left-eye parallax image, inter-pixel switch 15 is turned to the connected state to form a pixel circuit pair, the voltages of the storage capacities of the pixel circuits in the pixel circuit pair are alternately updated based on image signals of the parallax images, and in a period in which the voltage of storage capacity 33(*p, j*) of one pixel circuit 10(*p, j*) in the pixel circuit pair is updated, current switch 35(*p, j*) in one pixel circuit 10(*p, j*) is turned to the disconnected state and current switch 35(*p*+1, *j*) in the other pixel circuit 10(*p*+1, *j*) is turned to the connected state, and a current according to the voltage of storage capacity 33(*p*+1, *j*) of the other pixel circuit 10(*p*+1, *j*) is applied to the organic EL elements of the pixel circuits that form the pixel circuit pair, thereby causing the organic EL elements to emit light.

By driving in the above manner, it is possible to use the most part of the driving time for displaying an image, and thus to display a three-dimensional image with high luminance, although vertical resolution of the right-eye parallax image and the left-eye parallax image decreases.

The above embodiment has described the case in which data line drive circuit 11 sequentially supplies only the data signals for the odd numbered line to respective data lines 21(*j*) in the right-eye field and the left-eye field. However, data and its order to be supplied are not limited to the above. For example, only the data signals for the odd numbered line may be sequentially supplied to respective data lines 21(*j*) in the right-eye field and the left-eye field in the first frame, and only the data signals for the even numbered line may be sequentially supplied to respective data lines 21(*j*) in the right-eye field and the left-eye field in the next frame.

Second Exemplary Embodiment

Figure 7:
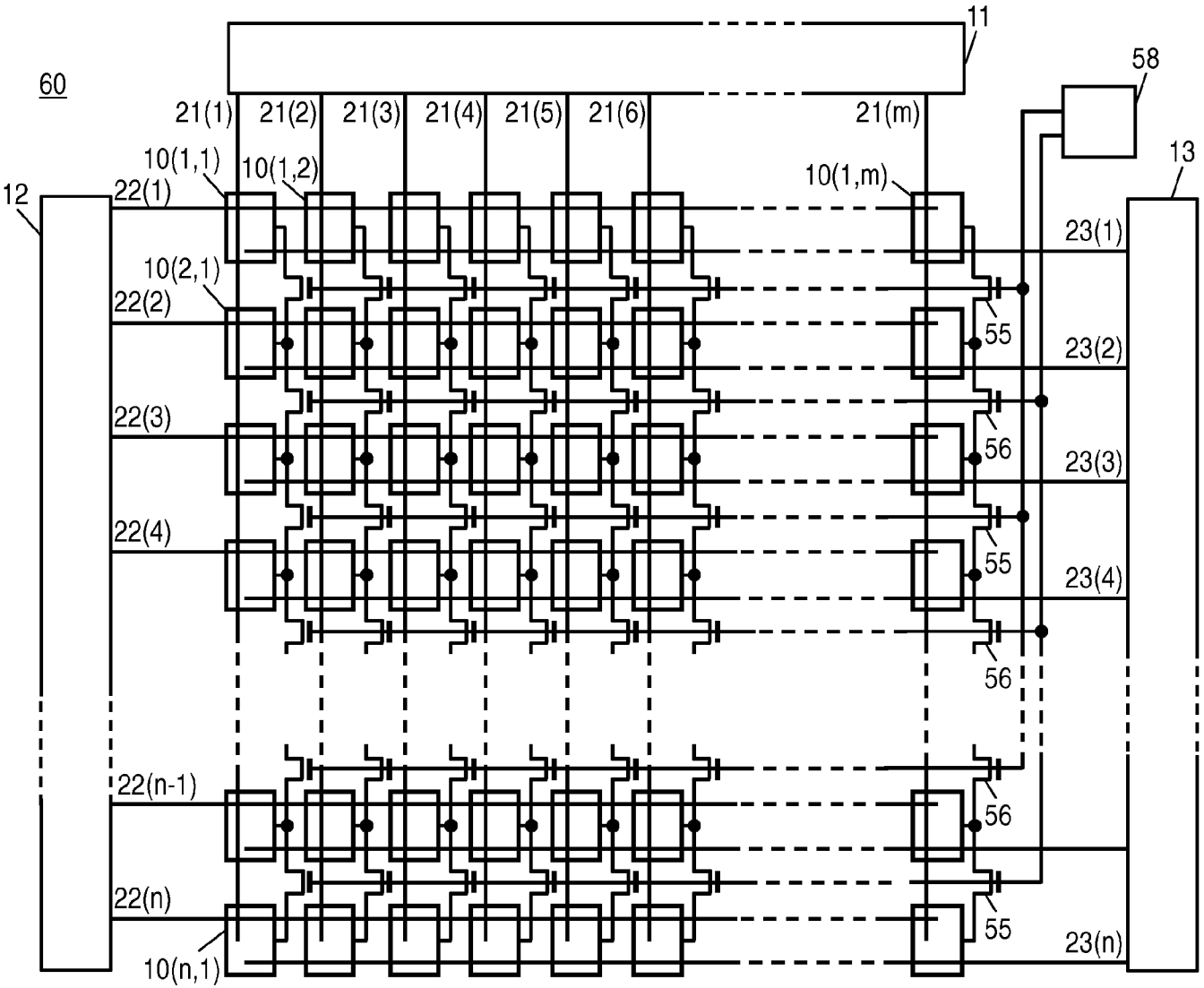
FIG. 7 is a schematic diagram illustrating a configuration of an organic EL display device according to a second embodiment.

FIG. 7 is a schematic diagram illustrating a configuration of organic EL display device 60 according to a second embodiment. Organic EL display device 60 according to this embodiment is provided with pixel circuits 10(*i, j*), data line drive circuit 11, scanning line drive circuit 12, light-emission control circuit 13, first inter-pixel switches 55, second inter-pixel switches 56, inter-pixel switch control circuit 58, and a power supply circuit (not depicted).

Like components as in organic EL display device 40 according to the first embodiment are denoted by like reference numerals as in the first embodiment, and descriptions for these components are omitted. Organic EL display device 60 according to the second embodiment is different from organic EL display device 40 according to the first embodiment in first inter-pixel switches 55, second inter-pixel switches 56, and inter-pixel switch control circuit 58.

First inter-pixel switches 55 are provided with respect to a pair of adjacent pixel circuits 10(*p, j*) and 10(*p*+1, *j*) so as to either connect or disconnect the organic EL elements of one pixel circuit 10(*p, j*) and the other pixel circuit 10(*p*+1, *j*). Here, "p" is an odd number from "1" to "n" inclusive. Further, second inter-pixel switches 56 are provided with respect to a pair of adjacent pixel circuits 10($q$, $j$) and 10($q$+1, $j$) so as to either connect or disconnect the organic EL elements of one pixel circuit 10($q$, $j$) and the other pixel circuit 10($q$+1, $j$). Here, "q" is an even number from "1" to "n" inclusive. Gates of first inter-pixel switches 55 are connected with each other, and gates of second inter-pixel switches 56 are also connected with each other.

As described above, according to the second embodiment, each of the plurality of pixel circuits 10($i$, $j$) sharing one of data lines 21($j$) is provided with first inter-pixel switch 55 that either connects or disconnects a node between organic EL element 32($p$, $j$) and current switch 35($p$, $j$) in pixel circuit 10($p$, $j$) having p-th scanning line 22($p$) and a node between organic EL element 32($p$+1, $j$) and current switch 35($p$+1, $j$) in pixel circuit 10($p$+1, $j$) having (p+1)th scanning line 22($p$+1), and second inter-pixel switch 56 that either connects or disconnects a node between organic EL element 32($q$, $j$) and current switch 35($q$, $j$) in pixel circuit 10($q$, $j$) having q-th scanning line 22($q$) and a node between organic EL element 32($q$+1, $j$) and current switch 35($q$+1, $j$) in pixel circuit 10($q$+1, $j$) having (q+1)th scanning line 22($q$+1).

Inter-pixel switch control circuit 58 supplies, according to an image signal, a first inter-pixel control signal for controlling connection or disconnection of each first inter-pixel switch 55 to a gate of corresponding first inter-pixel switch 55, and a second inter-pixel control signal for controlling connection or disconnection of each second inter-pixel switch 56 to a gate of corresponding second inter-pixel switch 56.

Next, a method of driving organic EL display device 60 according to the second embodiment will be described. When displaying a two-dimensional image, first inter-pixel switches 55 and second inter-pixel switches 56 are turned to a disconnected state so that pixel circuits 10($p$, $j$) for the odd numbered line and pixel circuits 10($q$, $j$) for the even numbered line independently operate without interfering each other. The detailed operation in this case is the same as that in the first embodiment, and therefore the description is omitted.

Next, a case in which a three-dimensional image is displayed is described.

Figure 8:
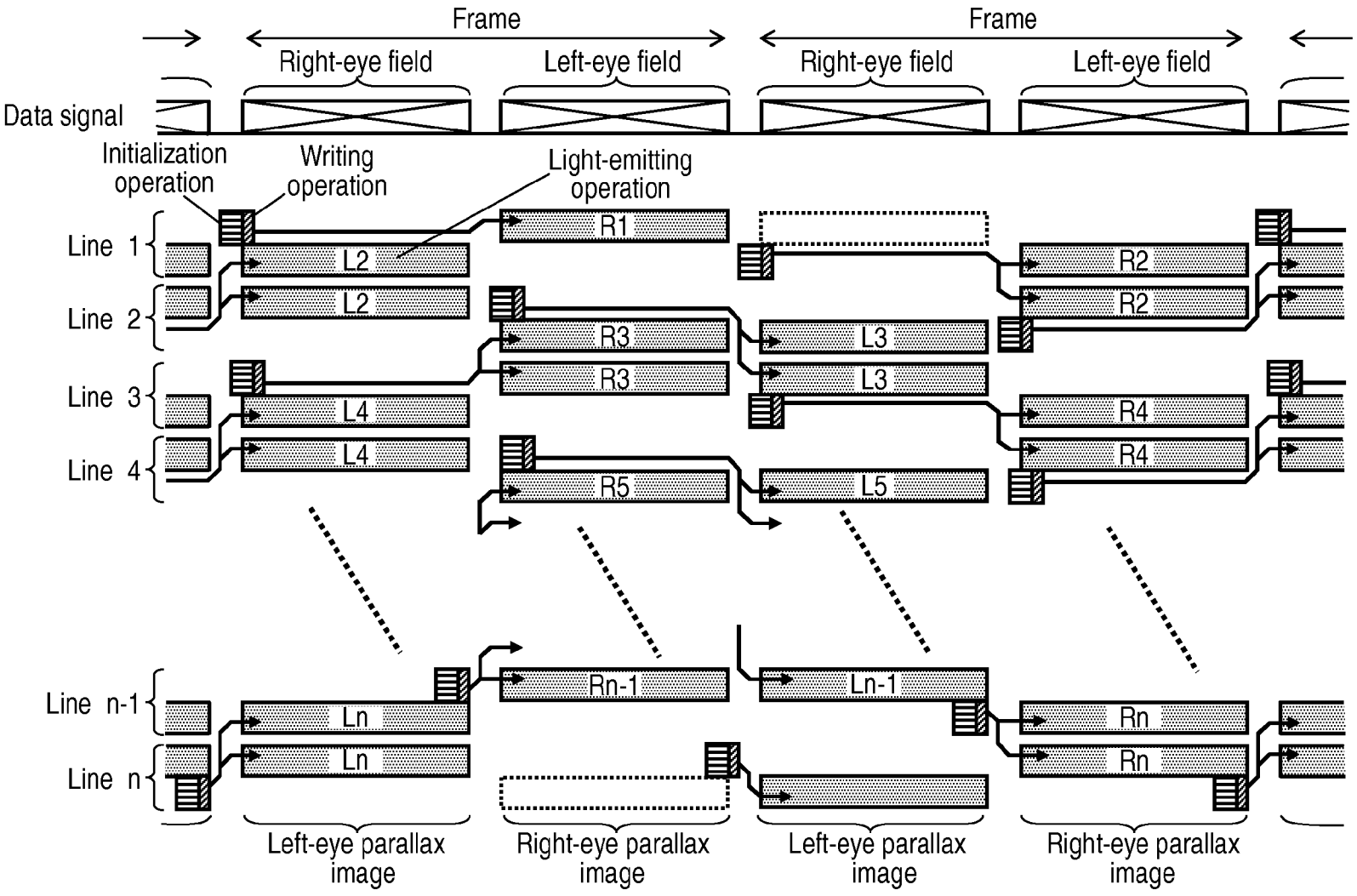
FIG. 8 is a timing chart for showing an operation of the organic EL display device.

FIG. 8 is a timing chart for showing the operation of organic EL display device 60 according to the second embodiment, when displaying a three-dimensional image.

In this embodiment, in the first frame, data line drive circuit 11 supplies, to each of data lines 21($j$), the right-eye data signal in the order of line 1, line 3, line 5, and so on in the right-eye field, and the left-eye data signal in the order of line 1, line 3, line 5, and so on in the subsequent left-eye field. Then, in the next frame, data line drive circuit 11 supplies the right-eye data signal in the order of line 2, line 4, line 6, and so on in the right-eye field, and the left-eye data signal in the order of line 2, line 4, line 6, and so on in the subsequent left-eye field. The description is provided assuming that data line drive circuit 11 thereafter supplies the data signal to each of data lines 21($j$) in the order described above in the same manner.

In the right-eye field in the first frame, first inter-pixel switch 55 is turned to a connected state and second inter-pixel switch 56 is turned to the disconnected state so as to connect organic EL element 32($p$, $j$) for the odd numbered line and organic EL element 32($p$+1, $j$) for the even numbered line. Then, similarly to the right-eye field in the first frame according to the first embodiment, the left-eye parallax image for the even numbered line is displayed by organic EL elements 32($p$, $j$) for the odd numbered line and organic EL elements 32($p$+1, $j$) for the even numbered line, while performing the writing operation for charging storage capacities 33($p$, $j$) of pixel circuits 10($p$, $j$) for the odd numbered line to voltages corresponding to right-eye data signals Rp corresponding to the odd numbered line of the right-eye parallax image.

Then, as the left-eye parallax image at this time, as illustrated in FIG. 8, left-eye data signals L2 for the second line are displayed by pixel circuits 10(1, $j$) for line 1 and pixel circuits 10(2, $j$) for line 2, left-eye data signals L4 for the fourth line are displayed by pixel circuits 10(3, $j$) for line 3 and pixel circuits 10(4, $j$) for line 4, . . . , and left-eye data signals Ln for the n-th line are displayed by pixel circuits 10($n$−1, j) for line (n−1) and pixel circuits 10($n$, $j$) for line n.

In the left-eye field in the same frame, first inter-pixel switch 55 is turned to the disconnected state and second inter-pixel switch 56 is turned to the connected state so as to connect organic EL element 32($q$, $j$) for the even numbered line and organic EL element 32($q$+1, $j$) for the odd numbered line. Then, the right-eye parallax image for the odd numbered line is displayed by organic EL elements 32($q$, $j$) for the even numbered line and organic EL elements 32($q$+1, $j$) for the odd numbered line, while performing the writing operation for charging storage capacities 33($q$, $j$) of pixel circuits 10($q$, $j$) for the even numbered line to voltages corresponding to left-eye data signals L(q+1) corresponding to the odd numbered line of the left-eye parallax image.

Then, as the right-eye parallax image at this time, right-eye data signals R1 for the first line are displayed by pixel circuits 10(1, $j$) for line 1, right-eye data signals R3 for the third line are displayed by pixel circuits 10(2, $j$) for line 2 and pixel circuits 10(3, $j$) for line 3, . . . , and right-eye data signals R (n−1) for the (n−1)th line are displayed by pixel circuits 10($n$−2, j) for line (n−2) and pixel circuits 10($n$−1, j) for line (n−1).

In the right-eye field in the next frame, first inter-pixel switch 55 remains to be in the disconnected state and second inter-pixel switch 56 remains to be in the connected state so as to connect organic EL element 32($q$, $j$) for the even numbered line and organic EL element 32($q$+1, $j$) for the odd numbered line. Then, the left-eye parallax image for the odd numbered line is displayed by organic EL elements 32($q$, $j$) for the even numbered line and organic EL elements 32($q$+1, $j$) for the odd numbered line, while performing the writing operation for charging storage capacities 33($q$−1, j) of pixel circuits 10($q$−1, j) for the odd numbered line to voltages corresponding to right-eye data signals Rq corresponding to the even numbered line of the right-eye parallax image.

Then, as the left-eye parallax image at this time, as illustrated in FIG. 8, left-eye data signals L3 for the third line are displayed by pixel circuits 10(2, $j$) for line 2 and pixel circuits 10(3, $j$) for line 3, left-eye data signals L5 for the fifth line are displayed by pixel circuits 10(4, $j$) for line 4 and pixel circuits 10(5, $j$) for line 5, . . . , and left-eye data signals L(n−1) for the (n−1)th line are displayed by pixel circuits 10($n$−2, j) for line (n−2) and pixel circuits 10($n$−1, j) for line (n−1).

In the left-eye field in the same frame after this, first inter-pixel switch 55 is turned to the connected state and second inter-pixel switch 56 is turned to the disconnected state so as to connect organic EL element 32($p$, $j$) for the odd numbered line and organic EL element 32($p$+1, $j$) for the even numbered line. Then, the right-eye parallax image for the even numbered line is displayed by organic EL elements 32($p$, $j$) for the odd numbered line and organic EL elements 32($p$+1, $j$) for the even numbered line, while performing the writing operation for charging storage capacities 33($p$+1, $j$) of pixel circuits 10($p$+1, $j$) for the even numbered line to voltages corresponding to left-eye data signals L(p+1) corresponding to the even numbered line of the left-eye parallax image.

Then, as the right-eye parallax image at this time, as illustrated in FIG. 8, right-eye data signal R2 for the second line is displayed by pixel circuits 10(1, *j*) for line 1 and pixel circuits 10(2, *j*) for line 2, right-eye data signal R4 for the fourth line is displayed by pixel circuits 10(3, *j*) for line 3 and pixel circuits 10(4, *j*) for line 4, . . . , and right-eye data signal Rn for the n-th line is displayed by pixel circuits 10(*n*−1, j) for line (n−1) and pixel circuits 10(*n, j*) for line n.

As described above, when displaying a three-dimensional image by alternately displaying the right-eye parallax image and the left-eye parallax image, one of first inter-pixel switch 55 and second inter-pixel switch 56 is turned to the connected state and the other is turned to the disconnected state to form a pixel circuit pair, the voltages of the storage capacities of the pixel circuits in the pixel circuit pair are alternately updated based on image signals of the parallax images, and in a period in which the voltage of the storage capacity of one of the pixel circuits in the pixel circuit pair is updated, the current switch in the one of the pixel circuits is turned to the disconnected state and the current switch in the other of the pixel circuits is turned to the connected state, and a current according to the voltage of the storage capacity of the other of the pixel circuits is applied to the organic EL elements of the pixel circuits that form the pixel circuit pair, thereby causing the organic EL elements to emit light. Then, the first inter-pixel switch and the second inter-pixel switch are alternately switched between the connected state and the disconnected state frame by frame.

By driving in the above manner, it is possible to use the most part of the driving time for displaying an image, and thus to display a three-dimensional image with high luminance. Further, it is possible to display a three-dimensional image with high vertical resolution, as interlaced display is performed for both of the right-eye parallax image and the left-eye parallax image.

According to the first and second embodiments, it has been described that the pixel circuits in an organic EL display device are arranged in matrix, and the inter-pixel switches share the data line and connected to both of the pair of adjacent pixel circuits in the column direction. However, the present invention is not limited to such an example. The pixel circuits in an organic EL display device may be arranged in a delta pattern, for example. Further, as long as the inter-pixel switch is connected to both of the pair of pixel circuits each having an organic EL element emitting light of the same color, any configuration of the inter-pixel switch may be employed.

Moreover, specific values used in the embodiments are mere examples, and it is desirable that such values be set to be optimal values as needed according to characteristics of pixel circuits and specifications of an organic EL display device.

What is claimed is:

1. An organic EL display device, comprising:

an array of a plurality of pixel circuits, each of the pixel circuits including:

an organic EL element;

a storage capacity for holding a voltage corresponding to an image signal;

a drive transistor for applying a current to the organic EL element, the current corresponding to the voltage of the storage capacity; and a current switch for either connecting or disconnecting the drive transistor with the organic EL element; and an inter-pixel switch for connecting or disconnecting a node located between the organic EL element and the current switch in one of a pair of the pixel circuits that are adjacent to each other and a node between the organic EL element and the current switch in the other of the pair of the pixel circuits, and in a three-dimensional image display period in which the voltage of the storage capacity of one of the pixel circuits in the pixel circuit pair is updated, turning the current switch in the one of the pixel circuits to a disconnected state and turning the current switch in the other of the pixel circuits to a connected state, applying a current in response to the voltage of the storage capacity of the other of the pixel circuits to the organic EL elements of the pixel circuits that form the pixel circuit pair to cause the organic EL elements to emit light.

2. A method of driving an organic EL display device, comprising:

when displaying a two-dimensional image, turning the inter-pixel switch to a disconnected state;

driving the organic EL display device as claimed in claim 1, the method further comprising:

sequentially updating the voltage of the storage capacity of the pixel circuit in response to an image signal of the two-dimensional image;

and applying a current in response to the updated voltage of the storage capacity to the organic EL element of the pixel circuit to cause the organic EL element to emit light;

the method further comprising: when displaying the three-dimensional image by alternately displaying a right-eye parallax image and a left-eye parallax image, turning the inter-pixel switch to a connected state to form a pixel circuit pair;

alternately updating the voltages of the storage capacities of the pixel circuits in the pixel circuit pair based on image signals of the parallax images.

3. An organic EL display device, comprising:

pixel circuits disposed respectively at intersections between a plurality of data lines and a plurality of scanning lines that intersect the data lines, each one of the pixel circuits including:

an organic EL element;

a storage capacity for holding a voltage corresponding to an image signal; a drive transistor for applying a current to the organic EL element, the current corresponding to the voltage of the storage capacity; and a current switch for either connecting or disconnecting the drive transistor with the organic EL element, wherein each of a plurality of the pixel circuits sharing one of the data lines includes:

a first inter-pixel switch for connecting or disconnecting a node located between the organic EL element and the current switch in the pixel circuit having a p-th line of the scanning lines (where p is an odd number) and a node between the organic EL element and the current switch in the pixel circuit having a (p+1)th line of the scanning lines; and a second inter-pixel switch for connecting or disconnecting a node located between the organic EL element and the current switch in the pixel circuit having a q-th line of the scanning lines (where q is an even number) and a node between the organic EL element and the current switch in the pixel circuit having a (q+1)th line of the scanning lines, and in a three-dimensional image display period in which the voltage of the storage capacity of one of the pixel circuits in the pixel circuit pair is updated, turning the current switch in the one of the pixel circuits to a disconnected state and turning the current switch in the other of the pixel circuits to a connected state, applying a current in response to the voltage of the storage capacity of the other of the pixel circuits to the organic EL elements of the pixel circuits that form the pixel circuit pair to cause the organic EL elements to emit light.

4. A method of driving an organic EL display device, comprising:

when displaying a two-dimensional image, turning the first inter-pixel switch and the second inter-pixel switch to a disconnected state;

driving the organic EL display device as claimed in claim 3, the method further comprising:

sequentially updating the voltage of the storage capacity of the pixel circuit in response to an image signal of the two-dimensional image;

applying a current in response to the updated voltage of the storage capacity to the organic EL element of the pixel circuit to cause the organic EL element to emit light;

the method further comprising: when displaying the three-dimensional image by alternately displaying a right-eye parallax image and a left-eye parallax image, turning one of the first inter-pixel switch and the second inter-pixel switch to a connected state and turning the other to a disconnected state to form a pixel circuit pair;

alternately updating the voltages of the storage capacities of the pixel circuits in the pixel circuit pair based on image signals of the parallax images.

5. The method according to claim 4 further comprising:

when displaying the three-dimensional image by alternately displaying the parallax images, alternately switching the first inter-pixel switch and the second inter-pixel switch between the connected state and the disconnected state frame by frame.

* * * * *